US007704138B2

(12) United States Patent
Tallal, Jr.

(10) Patent No.: US 7,704,138 B2
(45) Date of Patent: Apr. 27, 2010

(54) SYSTEM AND METHOD FOR MULTI-LEVEL MARKETING WAGERING

(75) Inventor: Joseph L. Tallal, Jr., Dallas, TX (US)

(73) Assignee: Global Mining & Marketing, LLC, Dallas, TX (US)

( * ) Notice: Subject to any disclaimer, the term of this patent is extended or adjusted under 35 U.S.C. 154(b) by 1110 days.

(21) Appl. No.: 10/824,629

(22) Filed: Apr. 14, 2004

(65) Prior Publication Data

US 2004/0224755 A1 Nov. 11, 2004

Related U.S. Application Data

(60) Provisional application No. 60/462,659, filed on Apr. 14, 2003.

(51) Int. Cl.
*A63F 9/24* (2006.01)

(52) U.S. Cl. ..... 463/16; 705/26

(58) Field of Classification Search ..... 463/16–20, 463/40–42; 705/26
See application file for complete search history.

(56) References Cited

U.S. PATENT DOCUMENTS

| | | | | |
|---|---|---|---|---|
| 6,319,122 | B1 * | 11/2001 | Packes et al. | 463/16 |
| 6,980,962 | B1 * | 12/2005 | Arganbright et al. | 705/26 |
| 7,359,871 | B1 * | 4/2008 | Paasche et al. | 705/26 |
| 2002/0094871 | A1 * | 7/2002 | Luciano et al. | 463/43 |
| 2002/0169835 | A1 * | 11/2002 | Paul et al. | 709/206 |
| 2004/0063494 | A1 * | 4/2004 | Oram et al. | 463/42 |

* cited by examiner

*Primary Examiner*—Peter DungBa Vo
*Assistant Examiner*—Masud Ahmed
(74) *Attorney, Agent, or Firm*—Daniel J. Chalker; Edwin S. Flores; Chalker Flores, LLP

(57) ABSTRACT

A system for multi-level wagering has one or more multi-level wagering accounts in which accumulated play value is stored. A computer may be used to track play value in the multi-level wagering accounts. Play value is distributed from a portion of the sales price of other multi-level wagering accounts, e.g., until a predetermined play value is achieved. One or more multi-level gaming machines may be operated by play value from the multi-level wagering accounts.

45 Claims, 12 Drawing Sheets

| | PURCHASE PRICE | GOES TO CARD #1 | GOES TO CARD #2 | GOES TO CARD #3 | GOES TO CARD #4 | GOES TO CARD #5 | GOES TO CARD #6 | GOES TO CARD #7 | GOES TO CARD #8 | GOES TO CARD #9 | GOES TO CARD #10 | GOES TO CARD #11 |
|---|---|---|---|---|---|---|---|---|---|---|---|---|
| CARD #1 | $5.00 | | | | | | | | | | | |
| CARD #2 | $5.00 | $0.25 | | | | | | | | | | |
| CARD #3 | $5.00 | $0.25 | | | | | | | | | | |
| CARD #4 | $5.00 | $0.25 | $0.25 | | | | | | | | | |
| CARD #5 | $5.00 | $0.25 | $0.25 | | | | | | | | | |
| CARD #6 | $5.00 | $0.25 | | $0.25 | | | | | | | | |
| CARD #7 | $5.00 | $0.25 | | $0.25 | | | | | | | | |
| CARD #8 | $5.00 | $0.50 | $0.25 | | $0.25 | | | | | | | |
| CARD #9 | $5.00 | $0.50 | $0.25 | | $0.25 | | | | | | | |
| CARD #10 | $5.00 | $0.50 | $0.25 | | | $0.25 | | | | | | |
| CARD #11 | $5.00 | $0.50 | $0.25 | | | $0.25 | | | | | | |
| CARD #12 | $5.00 | $0.50 | | $0.25 | | | $0.25 | | | | | |
| CARD #13 | $5.00 | $0.50 | | $0.25 | | | $0.25 | | | | | |
| CARD #14 | $5.00 | $0.50 | | $0.25 | | | | $0.25 | | | | |
| CARD #15 | $5.00 | $0.50 | | $0.25 | | | | $0.25 | | | | |
| CARD #16 | $5.00 | $3.00 | $0.50 | | $0.25 | | | | $0.25 | | | |
| CARD #17 | $5.00 | $3.00 | $0.50 | | $0.25 | | | | $0.25 | | | |
| CARD #18 | $5.00 | $3.00 | $0.50 | | $0.25 | | | | | $0.25 | | |
| CARD #19 | $5.00 | $3.00 | $0.50 | | $0.25 | | | | | $0.25 | | |
| CARD #20 | $5.00 | $3.00 | $0.50 | | | $0.25 | | | | | $0.25 | |
| CARD #21 | $5.00 | $3.00 | $0.50 | | | $0.25 | | | | | $0.25 | |
| CARD #22 | $5.00 | $3.00 | $0.50 | | | $0.25 | | | | | | $0.25 |

TO FIG. 8C

TO FIG. 8B

FIG. 8A

FIG. 8B

FROM FIG. 8A

| | | | | | | | | | | | | |
|---|---|---|---|---|---|---|---|---|---|---|---|---|
| CARD #23 | $5.00 | $3.00 | $0.50 | | | $0.25 | | | | | | $0.25 |
| CARD #24 | $5.00 | $3.00 | | $0.50 | | | $0.25 | | | | | |
| CARD #25 | $5.00 | $3.00 | | $0.50 | | | $0.25 | | | | | |
| CARD #26 | $5.00 | $3.00 | | $0.50 | | | $0.25 | | | | | |
| CARD #27 | $5.00 | $3.00 | | $0.50 | | | $0.25 | | | | | |
| CARD #28 | $5.00 | $3.00 | | $0.50 | | | | $0.25 | | | | |
| CARD #29 | $5.00 | $3.00 | | $0.50 | | | | $0.25 | | | | |
| CARD #30 | $5.00 | $3.00 | | $0.50 | | | | $0.25 | | | | |
| CARD #31 | $5.00 | $3.00 | | $0.50 | | | | $0.25 | | | | |
| CARD #32 | $5.00 | | $3.00 | | $0.50 | | | | $0.25 | | | |
| CARD #33 | $5.00 | | $3.00 | | $0.50 | | | | $0.25 | | | |
| CARD #34 | $5.00 | | $3.00 | | $0.50 | | | | $0.25 | | | |
| CARD #35 | $5.00 | | $3.00 | | $0.50 | | | | $0.25 | | | |
| CARD #36 | $5.00 | | $3.00 | | $0.50 | | | | | $0.25 | | |
| CARD #37 | $5.00 | | $3.00 | | $0.50 | | | | | $0.25 | | |
| CARD #38 | $5.00 | | $3.00 | | $0.50 | | | | | $0.25 | | |
| CARD #39 | $5.00 | | $3.00 | | $0.50 | | | | | $0.25 | | |
| CARD #40 | $5.00 | | $3.00 | | | $0.50 | | | | | $0.25 | |
| CARD #41 | $5.00 | | $3.00 | | | $0.50 | | | | | $0.25 | |
| CARD #42 | $5.00 | | $3.00 | | | $0.50 | | | | | $0.25 | |
| CARD #43 | $5.00 | | $3.00 | | | $0.50 | | | | | $0.25 | |
| CARD #44 | $5.00 | | $3.00 | | | $0.50 | | | | | | $0.25 |
| CARD #45 | $5.00 | | $3.00 | | | $0.50 | | | | | | $0.25 |
| CARD #46 | $5.00 | | $3.00 | | | $0.50 | | | | | | $0.25 |
| CARD #47 | $5.00 | | $3.00 | | | $0.50 | | | | | | $0.25 |
| TOTAL | | $53.50 | $53.50 | $5.50 | $5.50 | $5.50 | $1.50 | $1.50 | $1.50 | $1.50 | $1.50 | $1.50 |

TO FIG. 8D

FROM FIG. 8A

| GOES TO CARD #12 | GOES TO CARD #13 | GOES TO CARD #14 | GOES TO CARD #15 | GOES TO CARD #16 | GOES TO CARD #17 | GOES TO CARD #18 | GOES TO CARD #19 | GOES TO CARD #20 | GOES TO CARD #21 | GOES TO CARD #22 | GOES TO CARD #23 | GOES TO HOUSE | TOTAL PAID OUT* |
|---|---|---|---|---|---|---|---|---|---|---|---|---|---|
| | | | | | | | | | | | | $1.00 | $1.25 |
| | | | | | | | | | | | | $1.00 | $1.25 |
| | | | | | | | | | | | | $1.00 | $1.50 |
| | | | | | | | | | | | | $1.00 | $1.50 |
| | | | | | | | | | | | | $1.00 | $1.50 |
| | | | | | | | | | | | | $1.00 | $1.50 |
| | | | | | | | | | | | | $1.00 | $2.00 |
| | | | | | | | | | | | | $1.00 | $2.00 |
| | | | | | | | | | | | | $1.00 | $2.00 |
| | | | | | | | | | | | | $1.00 | $2.00 |
| | | | | | | | | | | | | $1.00 | $2.00 |
| | | | | | | | | | | | | $1.00 | $2.00 |
| | | | | | | | | | | | | $1.00 | $2.00 |
| | | | | | | | | | | | | $1.00 | $2.00 |
| | | | | | | | | | | | | $1.00 | $5.00 |
| | | | | | | | | | | | | $1.00 | $5.00 |
| | | | | | | | | | | | | $1.00 | $5.00 |
| | | | | | | | | | | | | $1.00 | $5.00 |
| | | | | | | | | | | | | $1.00 | $5.00 |
| | | | | | | | | | | | | $1.00 | $5.00 |
| | | | | | | | | | | | | $1.00 | $5.00 |

TO FIG. 8D

*House get any excess while the initial game ramps up to full matrix payout.

FIG. 8C

FIG. 8D

FROM FIG. 8C

| | | |

SYSTEM AND METHOD FOR MULTI-LEVEL MARKETING WAGERING

PRIORITY CLAIM

This patent application claims priority to U.S. provisional patent application Ser. No. 60/462,659 filed on Apr. 14, 2003.

TECHNICAL FIELD OF THE INVENTION

This invention generally relates to a system and method for multi-level wagering and in particular relates to monitoring accumulation of value from multiple sources in a wagering account and allowing a user to wager the accumulated value in a network of wagering devices.

BACKGROUND OF THE INVENTION

Without limiting the scope of the invention, its background is described in connection with the gaming industry and is best exemplified by casinos and other gambling facilities. Gaming systems have changed dramatically over the last few decades. The player either wins or loses his particular bet according to the odds of winning or losing based on the nature of the game, that is, the odds for winning or losing a wager based on a random event with generally known odds.

With the proliferation of computers and computer networks, computerized slot, poker or black jack machines, for example, began to be connected to a network of machines within, for example, a row, a hall or even throughout a region. Networked slot machines, for example, such as progressive slot machines, are connected between airports, restaurants, casinos, and other gaming locations. Networking the slot machines allowed for greater jackpots to be won by any one particular player in any gaming establishment.

SUMMARY OF THE INVENTION

The present invention is based, in part, on the recognition that wagering machines, such as progressive machines available currently, fail to take advantage of the benefit of multi-level marketing payout systems. Multi-level marketing businesses such as, Amway and Mary Kay, for example, have been in existence for decades and provide their members with a portion of the profits of the sale of a private label product available for sale only from members of the marketing network. One of the attractive features of a multi-level marketing business is that existing members of the business directly receive income from subsequent members' sales. By recruiting other people to join the network, a member profits from each subsequent member's or members' sales in the chain below.

The present invention provides a method, apparatus and system of gaming that has a payout system based on a multi-level marketing business without the requirement to recruit new members or sell any products. The present invention also provides increased profits to the gaming industry from increased play. In addition, the present invention provides significantly greater opportunity for winning to a player by combining a multi-level marketing payout structure with, e.g., a progressive gaming machine network.

The present invention combines a multi-level marketing business payout system with a gaming system. The result is a multi-level wagering system and method in which a player purchases one or more multi-level wagering account(s) from within a multi-level wagering system. The system for multi-level wagering creates the one or more multi-level wagering accounts and a computer program tracks the purchase of subsequent accounts that are used to distribute "play value" to the multi-level wagering accounts that are purchased subsequent to the first multi-level wagering account. Play value is distributed from a portion of the sales price of the purchase of other multi-level wagering accounts through a formula calculation until a predetermined maximum play value is achieved. Then, one or more multi-level gaming machines connected to the computer network are capable of being operated from the accumulated play value from a wagering account.

A "multi-level wagering account" as defined herein is an individual account, e.g., an account number, that is used to track an "account," which is a depository of accumulated "play value." As used herein, "play value" is used to define the accumulated value that may be used to pay for wagering (typically represented by a currency amount), that is, the purchase of one or more wagers on, e.g., a gaming machine, a networked gaming machine and the like. The account holder is able to use the accumulated "play value" at any time, whether the matrix below has been filled or not, on a gaming system and from that play on the gaming system may be able to make gambling earnings or winnings. A "play" is merely the purchase of a gaming event, e.g., play on an electronic or non-electronic slot machines, black jack or poker, at a gaming table or even play on a non-wagering machine, e.g., a video game. In the system and method of the present invention at least a portion of the (or the entire) "play value" may be used to buy a "play" on a gambling machine (e.g., electronic slot machines, black jack or poker machines, computer games, network-based gaming systems accessible by one or more computers or communication devices, etc.) that are connected to a multi-level wagering system based on the value that has accumulated in the multi-level wagering account. Upon a "play," that portion of the account that has accumulated play value is deducted from the multi-level wagering account. Upon a "play" any winnings are deposited in the multi-level "cash" account which may be withdrawn on demand. The multi-level wagering and its cash account may be tracked or accessed by a number of systems, e.g., over the Internet, on a touch screen, on a card, a smart card, a smart token, a receipt, a chip, a RFID device, a personal data assistant ("PDA"), a communications device, a print-out or other personal device, using an account number and a password or biometric data, such as voice-recognition, fingerprint, retinal scan, and the like.

In one embodiment of the invention, the multi-level wagering account corresponds to a place in, e.g. a one, two, three, four or more level matrix. Any other multi-level payout formulas may also be used, e.g., a 2×7, a 1×6 or other payout systems that use a multi-level payout formula. The multi-level wagering account (hereinafter "account") accumulates a particular predetermined number of plays based on the value distributed to the matrix by other accounts purchased following its original purchase. As the matrix is completed, the player of the account has a predetermined value that may then be used in a gaming machine and may win or lose money according to a particular gaming institution's odds at that gaming machine. Any winnings from playing a gaming machine may be drawn out in cash on demand.

Another feature of the present invention is that each particular matrix only requires a predetermined number of players to be fully complete. A gaming institution or operator earns money from selling the multi-level wagering account because the entire purchase price is not distributed back to the players in gaming play. The gaming institution also earns the gaming profits from all the wagering done by the multi-level wagering account in any particular gaming machine. The player receives the accumulated number of plays from the account and any winnings that may result from exercising the accumulated number of plays in a gaming machine are instantly converted to the player's multi-level cash account and may be withdrawn on demand.

The present invention also provides a system for wagering that includes a vending device, one or more gaming machines, a processor and a data storage device. The vending device accepts a sales price from a current user and assigns a multi-level wagering account having a play value to the current user. The one or more gaming machines allow at least a portion of the play value from the multi-level wagering account may be used to purchase a play. The processor is communicably coupled to the distribution device and the one or more gaming machines. The processor increases the play value of one or more multi-level wagering accounts of previous users based on the sale price accepted from the current user, increases the play value of the multi-level wagering account of the current user based on the sales price accepted from one or more subsequent users and decreases the play value of the multi-level wagering account of the current user based on the plays purchased by the current user at the one or more gaming machines. The data storage device is communicably coupled to the processor that stores the play value of each multi-level wagering account. Note that the vending device and the gaming machine can be integrated into a single device. Similarly, the processor and the data storage device can be integrated into a computer.

In addition, the present provides a method for wagering wherein a sales price is received from a current user, a multi-level wagering account having a play value is assigned to the current user wherein a portion of the play value may be used to purchase a play on one or more gaming machines. The play value of one or more multi-level wagering accounts of previous users is increased based on the sale price received from the current user, the play value of the multi-level wagering account of the current user is increased based on the sales price accepted from one or more subsequent users and the play value of the multi-level wagering account of the current user is decreased based on the plays purchased by the current user at the one or more gaming machines.

Other embodiments of the present invention may include: (1) a system that includes one or more multi-level wagering accounts, a processor communicably coupled to the one or more gaming machines that distributes play value in the one or more multi-level wagering accounts from a portion of the sales price of other multi-level wagering accounts, and one or more gaming machines wherein at least a portion of the play value from the one or more multi-level wagering accounts may be used to purchase a play; (2) a method of accumulating play value in a multi-level wagering account, and using the accumulated play value in a gaming machine; (3) a system that includes one or more multi-level wagering accounts, a processor communicably coupled to the one or more gaming machines that distributes play value in the multi-level wagering accounts from a portion of the sales price of the subsequent purchase of multi-level wagering accounts until a predetermined play value is achieved, and one or more gaming machines operated by the play value from the one or more multi-level wagering accounts; (4) a method of purchasing at least one multi-level wagering account, accumulating play value in the multi-level wagering account until a predetermined play value is achieved, and using the play value accumulated in the multi-level wagering account to purchase a play; (5) a system that includes one or more multi-level wagering cards, a processor that distributes play value in the multi-level wagering cards from a portion of the sales price of other multi-level wagering cards until a predetermined play value is achieved, and one or more gaming machines capable of being operated by play value from the one or more multi-level wagering cards; (6) a method of purchasing at least one multi-level wagering account, accumulating play value in the multi-level wagering account, and using the multi-level wagering account's accumulated play value to purchase a play; and (7) a system that includes one or more multi-level wagering cards, a means for distributing play value in the multi-level wagering cards from a portion of the sales price of other multi-level wagering cards until a predetermined play value is achieved, and one or more gaming machines capable of being operated by play value from the one or more multi-level wagering cards. Note that any of the methods described herein can be implemented as a computer program embodied on a computer readable medium wherein the various steps are performed by one or more code segments.

BRIEF DESCRIPTION OF THE FIGURES

For a more complete understanding of the present invention, including its features and advantages, reference is now made to the detailed description of the invention taken in conjunction with the accompanying drawings in which like numerals identify like parts and in which:

FIGS. 8A to 8D are a composite of a spreadsheet of one pay-out matrix according to the present invention.

DETAILED DESCRIPTION OF THE INVENTION

Figure 1A:
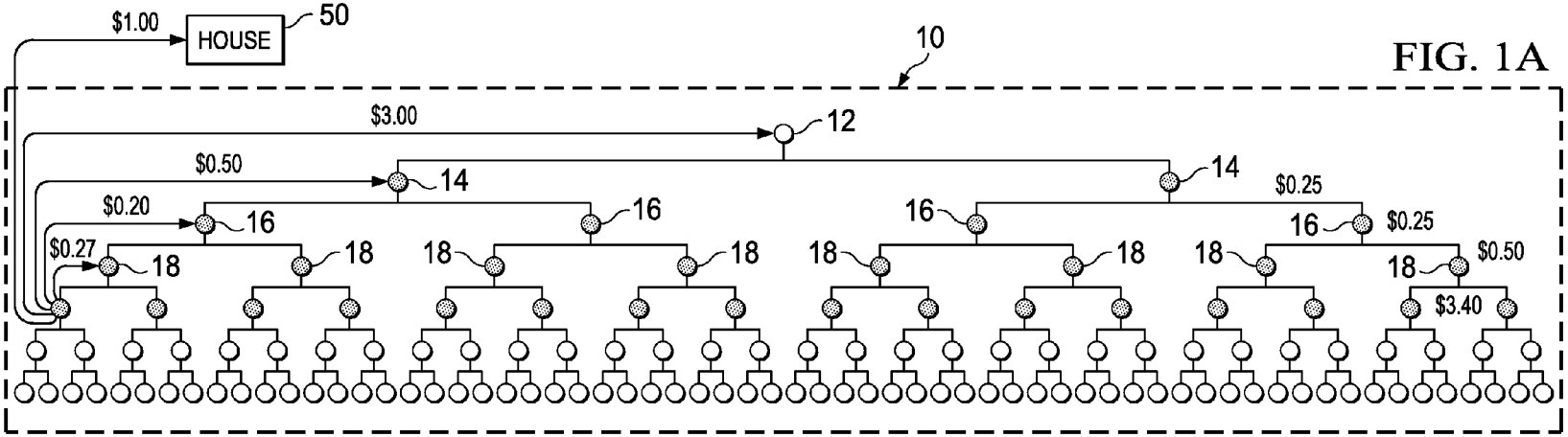
FIGS. 1A, 1B and 1C are schematic diagrams of a multi-level wagering matrix according to one embodiment of the present invention.

While the making and using of various embodiments of the present invention are discussed in detail below, it should be appreciated that the present invention provides many applicable inventive concepts that may be embodied in a wide variety of specific context. The specific embodiments discussed herein are merely illustrative of specific ways to make and use the invention and do not delimit the scope of the invention or the particular payout formulas.

A multi-level system of gaming in accordance with the present invention may be offered in airports, bars, casinos, clubs, hotels, restaurants or other locations where gaming is allowed, or via the Internet or other communication networks. A series of gaming machines are connected to a computer or communications network throughout a particular city or region. Individual gaming machines may be available in numerous locations, similar to the progressive slot machines that are networked together from airports, casinos, restaurants and other gaming locations. The gaming machines may include video slot machines, video poker or blackjack machines, one or more computer games, or a network-based gaming system accessible by one or more computers or communication devices.

The present invention provides a method, apparatus and system of gaming that has a payout system based on a multi-level marketing business without the requirement to recruit new members or sell any products. The present invention also provides increased profits to the gaming industry from increased play. In addition, the present invention provides significantly greater opportunity for winning to a player by combining a multi-level marketing payout structure with, e.g., a progressive gaming machine network.

The present invention combines a multi-level marketing business payout system with a gaming system. The result is a multi-level wagering system and method in which a player purchases one or more multi-level wagering account(s) from within a multi-level wagering system. The system for multi-level wagering creates the one or more multi-level wagering accounts and a computer program tracks the purchase of subsequent accounts that are used to distribute "play value" to the multi-level wagering accounts that are purchased subsequent to the first multi-level wagering account. Play value is distributed from a portion of the sales price of the purchase of other multi-level wagering accounts through a formula calculation until a predetermined maximum play value is achieved. Then, one or more multi-level gaming machines connected to the computer network are capable of being operated from the accumulated play value from a wagering account.

A "multi-level wagering account" as defined herein is an individual account, e.g., an account number, that is used to track an "account," which is a depository of accumulated "play value." As used herein, "play value" is used to define the accumulated value that may be used to pay for wagering (typically represented by a currency amount), that is, the purchase of one or more wagers on, e.g., a gaming machine, a networked gaming machine and the like. The account holder is able to use the accumulated "play value" at any time, whether the matrix below has been filled or not, on a gaming system and from that play on the gaming system may be able to make gambling earnings or winnings. A "play" is merely the purchase of a gaming event, e.g., play on an electronic or non-electronic slot machines, black jack or poker, at a gaming table or even play on a non-wagering machine, e.g., a video game. In the system and method of the present invention at least a portion of the (or the entire) "play value" may be used to buy a "play" on a gambling machine (e.g., electronic slot machines, black jack or poker machines, computer games, network-based gaming systems accessible by one or more computers or communication devices, etc.) that are connected to a multi-level wagering system based on the value that has accumulated in the multi-level wagering account. Upon a "play," that portion of the account that has accumulated play value is deducted from the multi-level wagering account. Upon a "play" any winnings are deposited in the multi-level "cash" account which may be withdrawn on demand. The multi-level wagering and its cash account may be tracked or accessed by a number of systems, e.g., over the Internet, on a touch screen, on a card, a smart card, a smart token, a receipt, a chip, a RFID device, a personal data assistant ("PDA"), a communications device, a print-out or other personal device, using an account number and a password or biometric data, such as voice-recognition, fingerprint, retinal scan, and the like.

In one example, an account may either be purchased from a dedicated vending machine used exclusively to sell a multi-level wagering account(s) or a multi-level wagering (MLW) machine that permits both purchase of an account and wagering. In one embodiment, the account may be purchased for, e.g., five dollars, although accounts may be purchased for lesser or greater amounts, such as one, ten, twenty, fifty, or one-hundred dollar (or other monetary unit) values. The account may be embodied in, e.g., a card may have a magnetic swipe strip, an IC chip, or other feature that contains a serial number or other code that identifies the account to the network. Smart cards, IC chips, bar codes, RFID devices, PDAs, communication devices, other personal items and the like may be used to identify a particular account in the system.

Figure 2A:
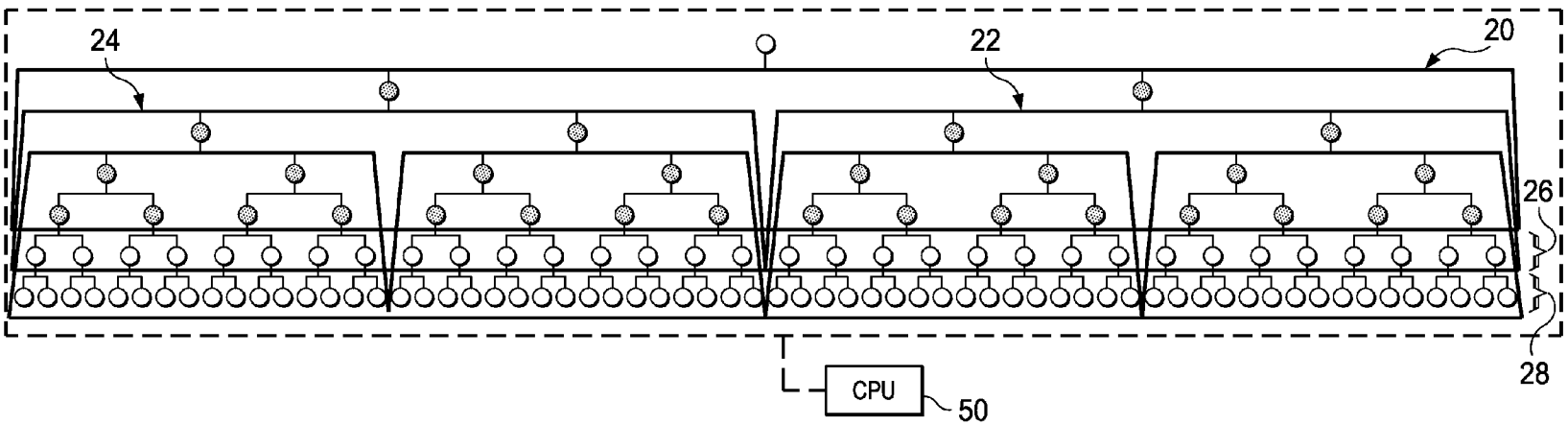
FIGS. 2A, 2B and 2C are diagrams of a multi-level wagering matrix according to one embodiment of the present invention.

Referring now to FIGS. 1A, and 2A, in one embodiment of the present invention, an initial five dollar investment using a binary matrix 10, for example, is immediately divided by a computer 50 into five distinct portions, $0.25, $0.25, $0.50, $3.00, and $1.00. The first four portions are distributed by the computer 50 to fill a binary matrix four levels deep 10 that resembles a multi-level marketing payout plan. Each of these portions is distributed to other purchaser's accounts upline, which are represented by locations 12, 14, 16, and 18, at higher levels within the binary four level deep matrix 10. One dollar is retained by the computer 50 for the house.

In this example, each account's maximum play value is based on a binary matrix 22, 24, 26, four levels deep. The individual spaces in the layers of the binary matrix 10 will be filled chronologically as new players purchase accounts. When the fourth level the binary matrix 10 below a particular player's account is completed, that account will have been fully funded and is then removed from the payout formula and accumulates no additional play value.

When the account's matrix 22, 24, 26, is completed, the player's account will have $53.50 (($0.25×6)+($0.50×8)+($3.00×16)). The house will take an additional $13.50 from the final level, leaving the account with an even $40.00. The play value of the account may be played as it is accumulated in a networked gaming machine. Any winnings are electronically recorded by the computer 50 and assigned to that particular cash account 12, 14, 16, 18 which can be withdrawn on demand. Because most gaming machines have a payout range of approximately 80% or more, an account that has accumulated $40.00 of play value will, on average, win about $32.00. Therefore, the player has a significant incentive to purchase the account because the initial investment was only five dollars. Additionally, because the accumulated $40.00 of play value is to be wagered in a gaming machine, the player has significant opportunities for winning more. A person would have to be very unlucky to not win at least $5.00 from wagering $40.00 and the upside winnings are almost limitless.

Figure 1B:
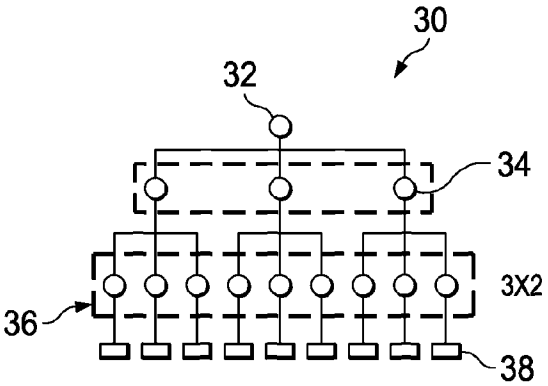
Figure 1C:
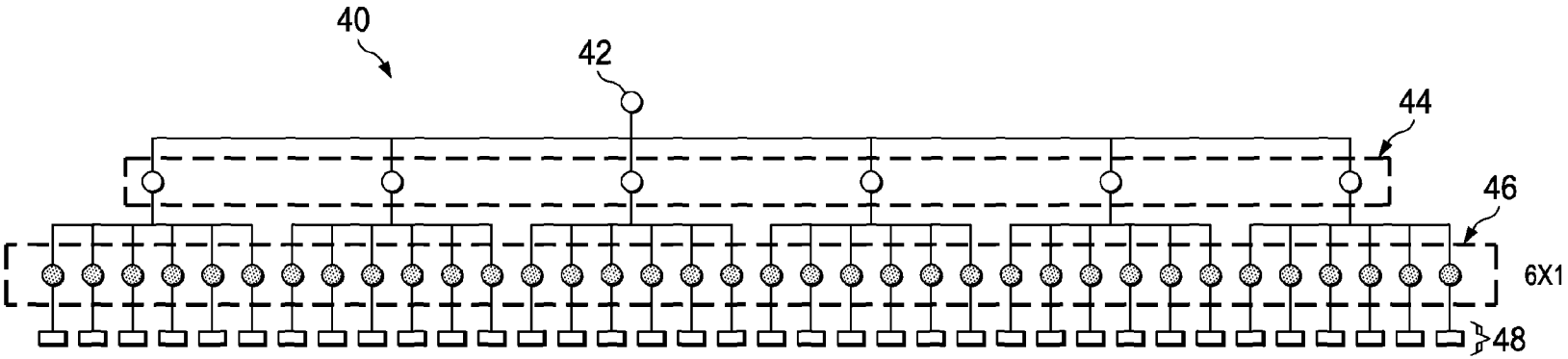
Figure 2B:
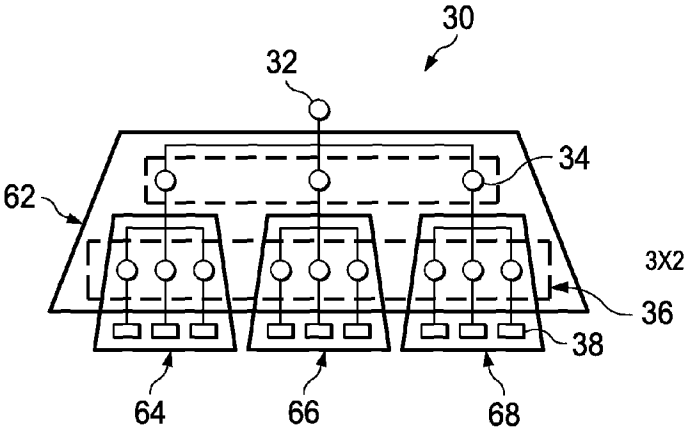

Alternative examples of matrix geometries are depicted in FIGS. 1B and 1C. In FIG. 1B, a matrix 30 is a three by two matrix. An account 32 is incrementally funded by three accounts in level 34, and nine accounts in level 36. Each block 38 represents three accounts in level 34 and nine accounts in level 36. FIG. 2B depicts individual matrices 62, 64, 66, 68 within the matrix 30. As discussed above, each new account within matrix 30 begins a new matrix. For example, each account in level 34 begins matrices 64, 66, 68 and is funded only by the accounts within the matrices 64, 66, 68. Alternatively, in FIG. 1C, a matrix 40 is a six by one matrix. An account 42 is incrementally funded by six accounts in level 44. Each account in level 46 funds accounts in level 44 immediately above the account in level 46.

As depicted in FIG. 2A a matrix 20 represents a progression of players that act to fund a particular account with additional play value according to one embodiment of the present invention. As more people purchase gaming accounts, the overall matrix becomes wider (containing each account's individual matrix 20, 22, 24), but at the same time more players per line 26, 28 are added to the overall binary matrix 10. Each gaming account matrix 20, 22, 24, however, only requires thirty other players to be fully completed. Each new multi-level wagering account matrix 20, 22, 24 begins in the next line of an existing matrix 10 and includes the next three rows of the existing matrix 10. In a four level binary matrix, for example, there will always be only three subsequent matrix lines of players who contribute to the account at the top of the particular matrix to which they belong. After all four layers are funded, a matrix is pushed up and out of the payoff equation. Because wagering establishments typically operate continuously and have a constant flow of customers, the time to complete a particular matrix may be very short. As customers continue to purchase accounts, the matrix system continues and expands because each new purchaser establishes the beginning of a new matrix.

Figure 2C:
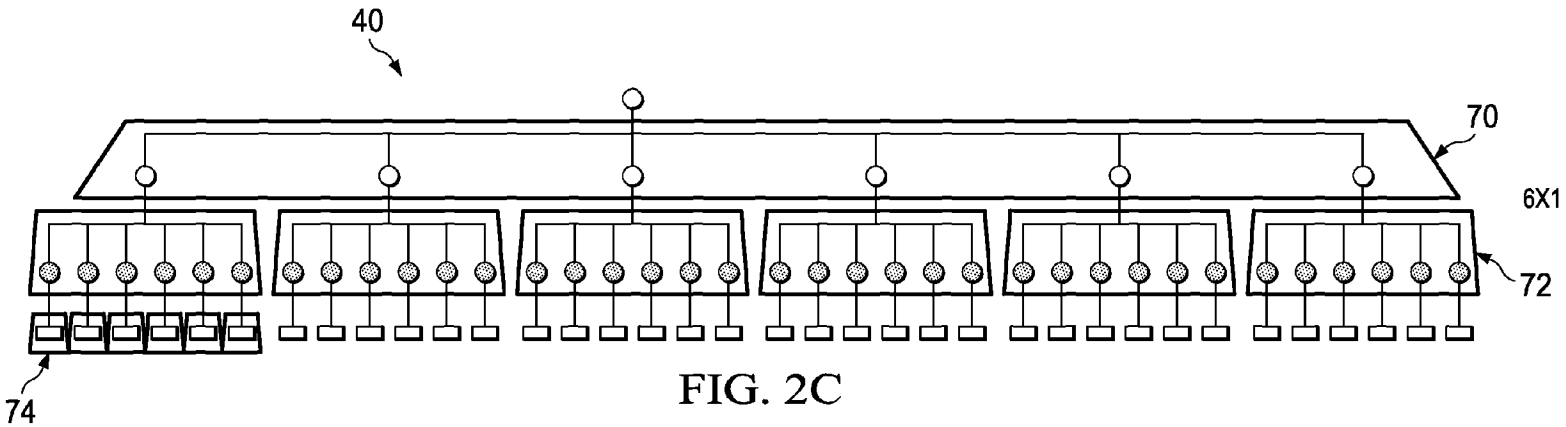

In short, according to this particular example, the house earns $14.50 ($1.00 off the top and $13.50 when the account's matrix is fully complete) plus the normal winnings from the slot machine plays on $40. The accountholder wins whatever $40 in slot machine plays yield. FIG. 2C depicts individual matrices 70, 72, 74 within the matrix 40. As discussed above, each new account within matrix 40 begins a new matrix.

Figure 3A:
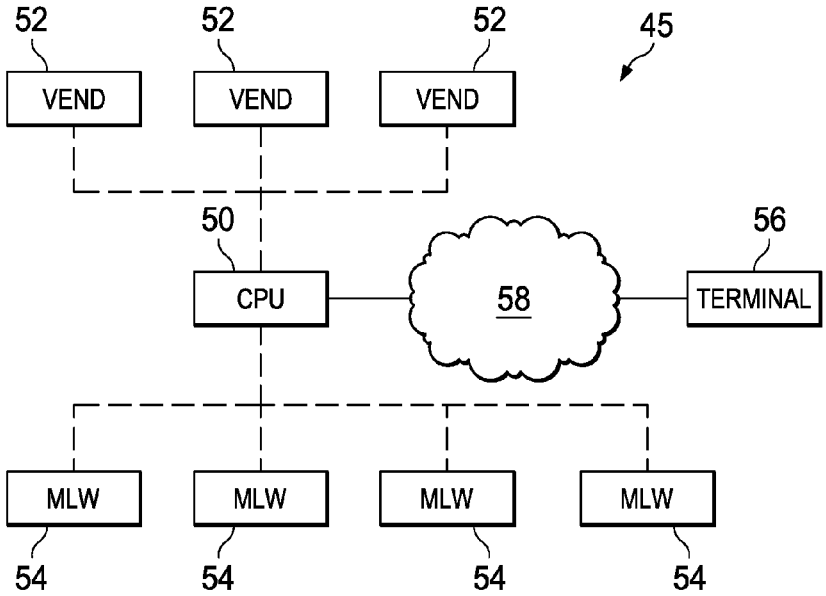
FIGS. 3A and 3B are schematic diagrams of a multi-level wagering network incorporating certain embodiments of the invention.

Turning now to FIG. 3A, according to one embodiment of the present invention, each MLW machine 54 throughout the network 45 may have a magnetic swipe device or other card reader so an account holder can swipe his card at anytime to monitor the play value accumulation. That accountholder's matrix 20, 22, 24 may be displayed on the video screen so a player may monitor the play level earned in his account. The MLW machine 54 may also display the cash value that has been acquired as the outcome of a particular play. Big current winners may also flash alternatively when not in use.

The overall MLW matrix for each account purchased is managed in the central computer 50 using standard MLM software (currently available throughout the MLM industry, programmed with a desired payout formula). Each MLW machine 54 may be connected to the computer 50 using phone/data, satellite or Internet connections. Because each account has its own identity, a running account of how much it has earned may be readily available at anytime. Additionally, the computer 50 may calculate an average fill time for the most recently completed accountholder's to have received the entire accumulated value. This information may also be displayed by a vending machine 52 whenever a new account is purchased or an existing player swipes, e.g., a card to check an account balance.

Each account may also have an ID number printed on the back below the magnetic strip. When in a hotel casino that offers MLW, the accountholder may access his current accumulated play value and any winnings from actual play from that account in his room by tuning an interactive television to a particular channel and keying in the number of his account using the TV remote.

A player may cash out the MLW cash portion of his account at any MLW machine 54 by swiping the account and selecting a payout button on the front of the machine. A player may also elect to purchase additional accounts from any vending machine 52 or MLW machine 54 with any winnings or use his winnings at any gaming table equipped to access the account's winnings.

A MLW machine 54 that has split-screen capability may also be developed so a slot player may monitor the accumulated play value of the player's account while playing the slot machine. The slot machine may also allow the player to transfer newly accumulated play value from the player's account to the slot machine.

Accumulated play value from a particular account may also be viewed by the Internet or other computer network. If a player leaving a particular gaming location purchases one or more gaming accounts upon departure, the player may monitor the accumulated play value of a particular account from a remote location 56 over a global communications network 58, such as the Internet, for example. Because the particular account's value may be available only in the particular location where the account was purchased, the player may be motivated to return to that location more quickly, especially if the player's account's value has accumulated a significant amount play value. Accumulated play value in the purchased accounts may defray the cost of a subsequent trip to the particular location. Gaming establishments in particular will recognize value from providing this incentive to account purchasers.

In one embodiment of the invention, a player may monitor and wager the account value from a remote location. For example, a player may use the Internet or other computer network to determine the value in a particular account and then wager the account value from the remote location. If the wager results in winnings, the player may claim the winnings either at the location where the account was purchased or from the remote location, depending on the laws of the remote location.

In one embodiment of the present invention, the MLW system may be marketed to a region's local residents, most of whom may not regularly go to casinos. Because time to accumulate play value is the main factor, the odds of accumulating value may be more attractive to local residents than other forms of wagering such as a lottery, for example.

Figure 3B:
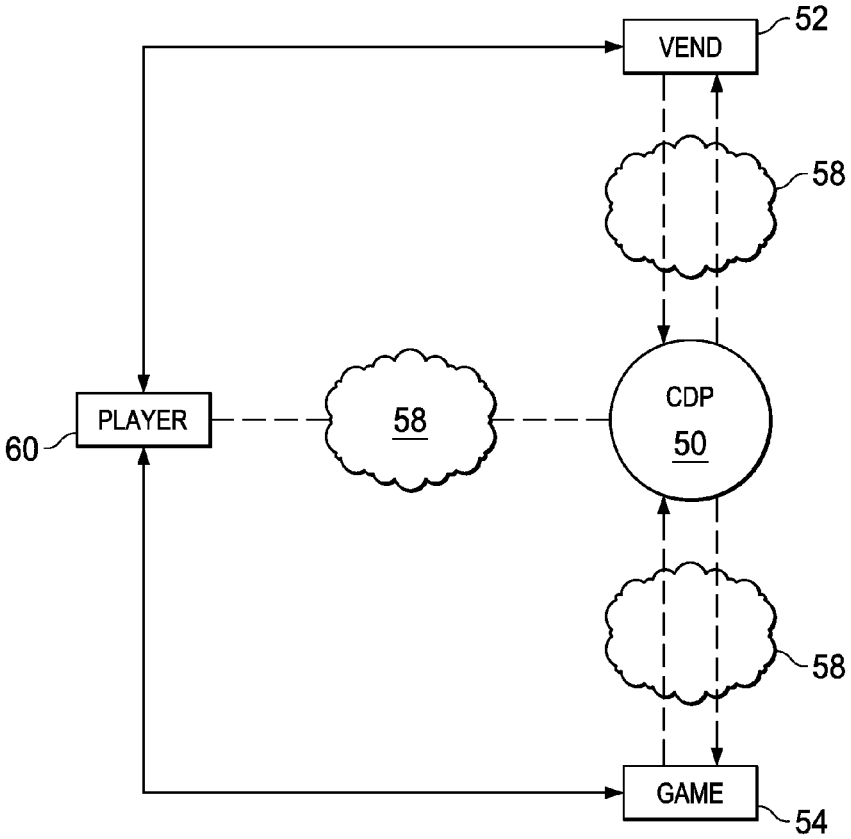

As depicted in FIG. 3B, terminals 52 at remote locations operated by the multi-level wagering account agents engage in bidirectional data communication with a central data processor 50 for each multi-level wagering account purchased. Likewise, terminals 52 and gaming devices 54 at remote locations operated by the multi-level wagering account agents engage in bidirectional data communication with a central data processor 50 for each account that has accumulated plays within the matrix for play on a network accessible gaming machine 54. The network accessible gaming machine 54 may be accessed via hardwire, infrared (IR), radio frequency (RF), wireless, microwave, LAN, WAN, satellite or any number of communication methods known or in development. The player 60 may access the information at any of these terminals 52, 54 or over an intra or internet 58. Each play must be properly entered in the gaming machine 54, to have its respective chance at winning and to guard against the possibility of a fraudulent claim of a win. The terminal 52, 54 at which each play was entered will generally be indexed to the play to enable the agent at that location to advise his customers to claim their winnings and also to guard against fraud. The player entry numbers for every multi-level wagering account and each gaming machine play must be scrupulously recorded and verified for later confirmation in the event of a win, and in order to run a fair multi-level wagering account system.

The particular communications which might be required to effect a play entry from an account, and account verification, which may include a report from the agent terminal of a play entry and the numbers selected by the user. The central processor 50 may answer back with a verification code and/or preferably repeats the play entry numbers back to the agent terminal to check the accuracy of reception. The numbers must be the same as printed by the agent terminal and as recorded at the central processor, because the player will rely on, e.g., printed multi-level wagering account information, smart card, etc. The particulars of each account and its play must be communicated to a secure location where the entries can be recorded for later comparison with entries presented by players to claim winnings. Typically, these communications may be handled over, e.g., pulse code modulated radio or telephone lines, and accordingly, the transmission includes a code representing the identity of the agent terminal. The central processor 50 may, e.g., assign a serial number to an entry and records the particulars of the entry.

Traditionally, "communications" undertaken in wagering systems amount to carrying written records of play entries from a point of sale to a secure central location, however, written records are openly readable and are prone to loss or alteration. Accordingly, high speed contemporaneous bidirectional data communications have substantially replaced written records. One or both systems may be used with the present invention. An agent terminal at the point of sale is operated typically by a multi-level wagering account agent to transmit player entry data to a central location and to accept a player entry verification from the central location indicating that the wager has been accepted and recorded, before the transaction is finalized by, e.g., adding account data to a card, smart card or printing a written record. This allows immediate sale of multi-level wagering account entries and prevents problems with loss, delay or alteration of records needed to confirm (at a later time) the number of plays accumulated in the account for purchase of game play. When a player plays on a gaming machine, the data at the central location can be compared to the data presented by the player from the multi-level wagering account to confirm valid play.

Where an agent terminal is in constant or intermittent data communication with the central processor, that is, when communicating with the central processor regarding entry of a wager, the terminal is said to be "on-line". The maintenance of a data communication link between a central data processor and one or more remote agent terminals presents a certain overhead in that the hardware necessary to support data communication must be dependably operative, and security functions are needed to prevent a spurious player entry or payout instruction.

It is possible to operate agent terminals off-line, in a manner similar to the operation of a lottery based on written records, however, the immediate verification of player entries is not then available, and the record produced is merely a digital record which has substantially the same content, and the same drawbacks, as a handwritten record. The record (for example a magnetic tape) can be read and altered relatively easily and may be used in limited circumstances. While off-line systems may be used, on-line system are more likely to be used because they provide the immediacy that most gaming enthusiast prefer. Using on-line systems, players and their multi-level wagering account(s) may bee verified contemporaneously and logged at the central multi-level wagering account location. When converting an off-line system to an on-line system or in more remote locations where distance, geography, population density and the like make mixed systems more useful, it may occur that not all of the off-line agents can be coupled into data communication with the on-line network. For example certain agents may be located in remote areas and it is often not practical, or cost effective, to provide the necessary hardware, perhaps including satellite communications, microwave relay stations, etc., which would enable contemporaneous communications with all potential agents or points of sale.

There may be circumstances where there is a need to enable a multi-level wagering account agent to operate one or more on-line agents with the necessary security and data capacity needed to handle wager acceptance recording, prompt verification and preferably payout management as that used for gaming machines. The multi-level wagering account system and gaming machine play system should enable quick and secure reporting, but require a minimum of hardware for the terminal system. For example, a data module may be provided for bidirectional communication with both the central processor and the agent terminal.

Bidirectional communication enables the link between the agent terminal and the agent data module to be quite secure, and the data module, preferably an integrated circuit card or smartcard, can independently protect security by automatically disabling itself when a breach of security or attempted breach of security is detected. The data uploaded or downloaded to the smartcard may be read and transmitted at the central processor location or at a limited number of agent access terminals or hub terminals which interface between the agent cards and the central processor. The agent access terminals or hubs may be provided at distributed locations, each available to one or more multi-level wagering account agents, thereby reducing the need for contemporaneous communications while reducing the delay in reporting wagers to the central location. The agents may upload readily a record of wagers accepted and obtain new account sales authorization information and payout information on a daily basis.

The multi-level wagering account agent data module is interactive and secure, e.g., using a smartcard or the like that can be programmed to communicate to the display or the gaming agent terminals any limitations which may apply to acceptance of wagers. The agent data module or smartcard can be stored with preset verifications as to potential wagers which are available and stored on the smartcard for sale. In this manner, the convenience and security of an on-line system can be combined with the low investment aspects of a semi-off-line system, thereby improving the availability and security of multi-level wagering account services to customers.

Another feature that may be attractive to players is a system of autoplay/autopay. In this particular embodiment, the player may select an option at the time the account is purchased wherein the play value is automatically wagered. The computer 50 may wager the predetermined play value of the account upon filling or as the account accumulates play value. Any winnings resulting from the autoplay may be sent by check or transferred to an account of the player if autopay is selected.

Video wagering games are popular gaming devices in casinos and other gaming establishments. A number of factors have contributed to the popularity of video wagering games. Gaming establishments have expanded the variety of games offered on video platforms beyond what was once limited to video poker, video keno and video reel slot machines. The present invention may be used with these and other forms of video gaming by communicating the amount of play in a multi-level wagering account with the final gaming machine. Many casino table games such as blackjack, draw poker, and poker, e.g., stud poker, are available on video. The plays accumulated in the account may be used in video games to learn the rules of the games on video machines before advancing to the more intimidating live table game environment. With video wagering, novice players can enjoy playing a wide variety of casino games without having to play at a table with other more experienced players who may create an intimidating environment for the novice. Using the present invention, players can increase the number of plays that they earn within the matrix at any point at which they are comfortable, that is, as they accumulate plays in their account they are entitled to cash-in the current amount of plays without, e.g., waiting for the entire matrix to be completed below them.

The present invention may even be used with video wagering games capable of paying a progressive jackpot, which offers the anticipation or hope for a very large award. For the above reasons, the video wagering format is growing at a pace which exceeds the growth of play of live casino table games and other types of live wagering.

One of the more commonly known video wagering games is poker, which is available in numerous variations. Other examples include video reel slot machines and video keno. Video reel slot machines may simulate the play of a mechanical slot machine such as a three reel slot, for example. Because the "reels" in a video gaming apparatus are not limited by the geometry of a conventional slot reel, the game can provide a larger number of pay lines or of winning combinations than can a conventional mechanical slot machine. All of these games may be played with the amount of play accumulated in the multi-level wagering account.

In fact, some video platforms are provided with the capability of the player being able to select from among a number of video wagering games. For example, some gaming establishments provide a number of poker game variations on one multi-game video platform, which may be played with the plays accumulated in each multi-level wagering account. The games are played independently, one-at-a-time, with no interrelationship between games.

Moreover, the present invention can be used on Internet gaming systems wherein the one or more gaming machines is a network-based gaming system accessible by one or more computers or communication devices, and the vending device is a network-based electronic accounting system associated with a network-based gaming system. Examples of such a system can be seen at Internet casino and poker websites.

The present invention also provides a system for wagering that includes a vending device, one or more gaming machines, a processor and a data storage device. The vending device accepts a sales price from a current user and assigns a multi-level wagering account having a play value to the current user. The one or more gaming machines allow at least a portion of the play value from the multi-level wagering account may be used to purchase a play. The processor is communicably coupled to the distribution device and the one or more gaming machines. The processor increases the play value of one or more multi-level wagering accounts of previous users based on the sale price accepted from the current user, increases the play value of the multi-level wagering account of the current user based on the sales price accepted from one or more subsequent users and decreases the play value of the multi-level wagering account of the current user based on the plays purchased by the current user at the one or more gaming machines. The data storage device is communicably coupled to the processor that stores the play value of each multi-level wagering account. Note that the vending device and the gaming machine can be integrated into a single device. Similarly, the processor and the data storage device can be integrated into a computer.

The vending device can also provide the current user with information about the multi-level wagering account that allows the current user to purchase the play on the one or more gaming machines. The information is stored on a magnetic medium on a card or can include an account number and a password or biometric data. The one or more gaming machines may include a video slot machine, or any type of computer wagering game.

The processor can also distribute a portion of each sales price accepted to an operator of the system. Moreover, the processor can increase the play value of the multi-level wagering accounts using a predetermined payout formula, which may be a one-level matrix, a multi-level matrix or a randomized payout formula. The processor can also record the quantity of play accumulated for each multi-level wagering account in the data storage device and/or one or more winnings resulting from using the multi-level wagering account in the one or more gaming machines in the data storage device. The winnings can them be associated with the multi-level wagering account, displayed at a remote location, transferred to a multi-level wagering account, used to place one or more wagers, or exchanged for cash.

The multi-level wagering account can be set to expire after a given time period. In such a case, any unused play value for an expired multi-level wagering account can be distributed to an operator of the system. The play value of one or more multi-level wagering accounts can be accessed from a remote location.

In addition, the present provides a method for wagering wherein a sales price is received from a current user, a multi-level wagering account having a play value is assigned to the current user wherein a portion of the play value may be used to purchase a play on one or more gaming machines. The play value of one or more multi-level wagering accounts of previous users is increased based on the sale price received from the current user, the play value of the multi-level wagering account of the current user is increased based on the sales price accepted from one or more subsequent users and the play value of the multi-level wagering account of the current user is decreased based on the plays purchased by the current user at the one or more gaming machines. Note that this method can be implemented as a computer program embodied on a computer readable medium wherein the various steps are performed by one or more code segments.

Figure 4:
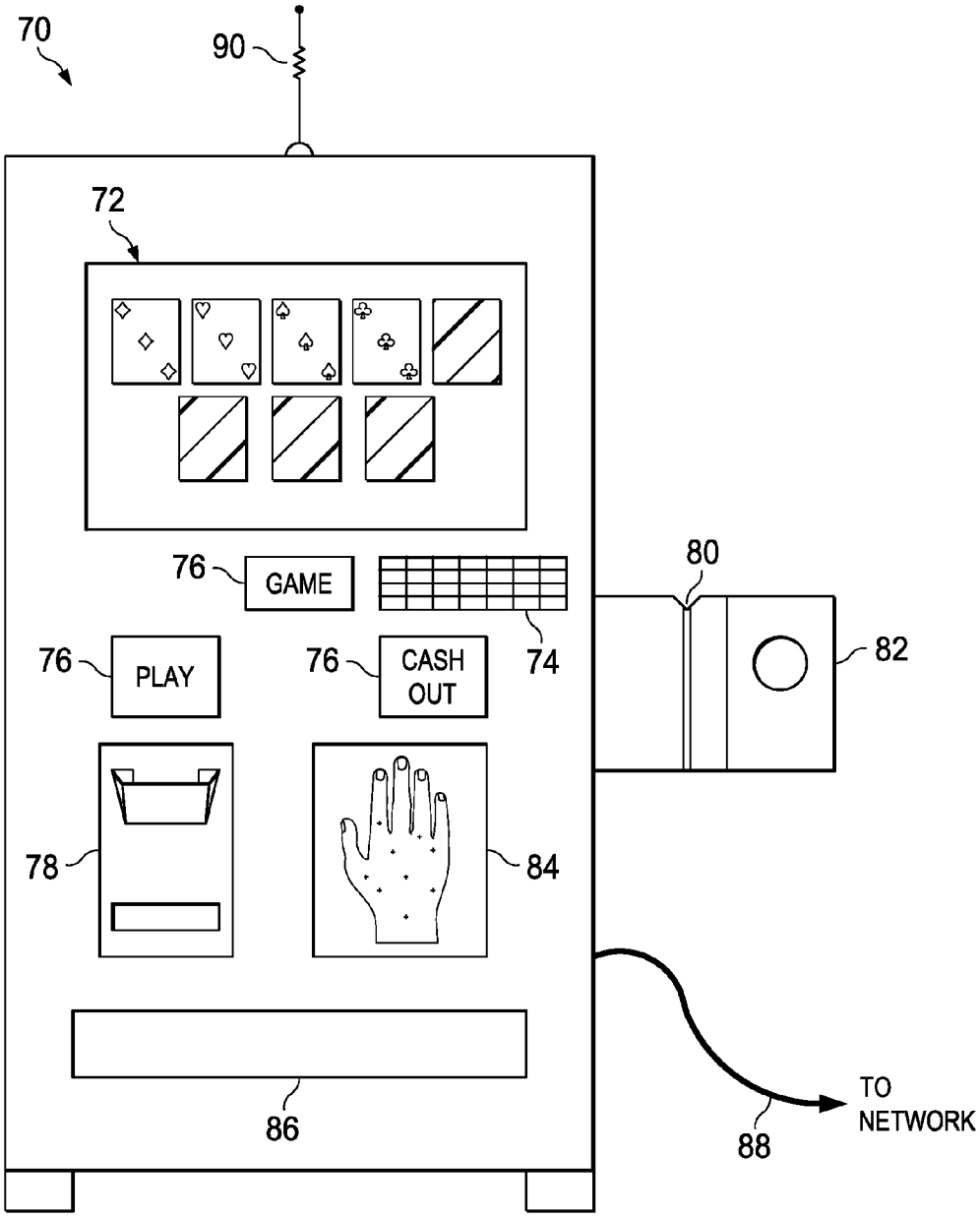
FIG. 4 is a diagram of a multi-level wagering machine according to one embodiment of the present invention.

FIG. 4 depicts a gaming machine 70 according to one embodiment of the present invention. The gaming machine 70 has a display 72 that may be configured to provide a gaming interface and also may display the player's account information. A keypad 74 allows a player to enter data such as account information, a payout request or the like into the gaming machine 70 or the central processor 50. Functional buttons 76 may be provided to start game play, change games or cash out. The functional buttons 76 may also be configured to actuate other functions of the gaming machine 70 such as calling for an attendant, accessing account information or communicating with another player. A payment acceptor 78 may be configured to accept various forms of payment to purchase an account. For example, the payment acceptor 78 may accept cash, credit cards, casino chips, tokens and the like.

The player may begin wagering account funds by swiping a bar code or magnetic card through a card reader 80, waving a smart card, integrated circuit card or the like by a card detector 82, or scanning a biometric such as a fingerprint, retina, palm print, DNA sample and the like through a biometric scanner 82. Other ways of uniquely identifying an account to effect wagering on the gaming machine 70 will be apparent to those having ordinary skill in the art of machine-processed identification techniques. A payout tray 86 delivers payout in the form of tokens, chips, cash or the like to the player. The payout tray 86 may also deliver an account receipt, data storage card, integrated circuit chip, or smart card to the player. The gaming machine may be connected to the central processor 50 and other gaming machines by hardwire 88 or by a wireless connection through an antenna 90.

In one embodiment, the application of a data storage card, e.g., an integrated circuit card or smartcard, may be used for to storage of player information in the multi-level wagering account. The smartcards are issued to players, for storage of value tokens as well as demographic information, which is useful to casino operators for making marketing decisions. The smartcard identifies a player and enables the player to purchase a balance to be applied against purchase of plays. The card is a substantial convenience to players and to a multi-level wagering account and casino operators because it is not necessary to enter manually a great deal of data in order to manage a play entry or the payout. The card, however, is not an operating element of the a multi-level wagering account system itself, and does not assist in communications needed between a central data processor (which issues play verifications) and the game play terminals (which accept wagers and authorize payouts). Furthermore, the amount of data storage required according to this technique is not large.

A smartcard in general is substantially the size of a credit card, has on-board memory and a processor for accessing the memory and for managing communications. Data transmission from the card, powering the card, and communication with the card may be accomplished via conductor pads presented on the card surface or by inductive coupling to coils in the card. The card may be accessed magnetically of via radio frequency modulation. When the card is inserted in a terminal operable to interface with the card, the necessary data transmission and power supply connections are made by appropriate contact and/or interface elements in the terminal. Smartcards such as those that contain customer account cards for banking services or as pay-for-usage cards which store a balance to be debited when the card is used, may be adapted for use with the present invention. When loading information (e.g., value credits or other data) and for unloading information (e.g., debiting the balance or reading the card contents), the processor on the smart card typically requires entry of a unique authorization code by the operator. If the correct code is not entered, the card is unusable, and may be arranged to disable itself in the event of an attempted unauthorized access or function. Smartcards according to this description are widely available.

In one embodiment, the multi-level wagering account agents may be self-service terminals that connect to the gaming machine wagering system, and may include: a memory containing the credit balance and information relating to an outstanding account. Information relating to the extent to which a matrix assigned to that multi-level wagering account is also stored in the system. A single ticket bearing an acknowledgment of the stored multi-level wagering account, an acknowledgment of the multi-level wagering account matrix balance, a machine-readable identification code and a form upon which machine-readable information relating to a gaming machine is used with accumulated play(s) may be updated at any terminal. The player may access information on a self-service basis at a multi-level wagering account purchase terminal, a multi-level wagering account matrix status display terminal or even a gaming machine terminal. In some embodiments a single terminal may serve to display any of the above information when a player inputs their account information, slides a card, passes a card over a reader and the like.

Figure 5:
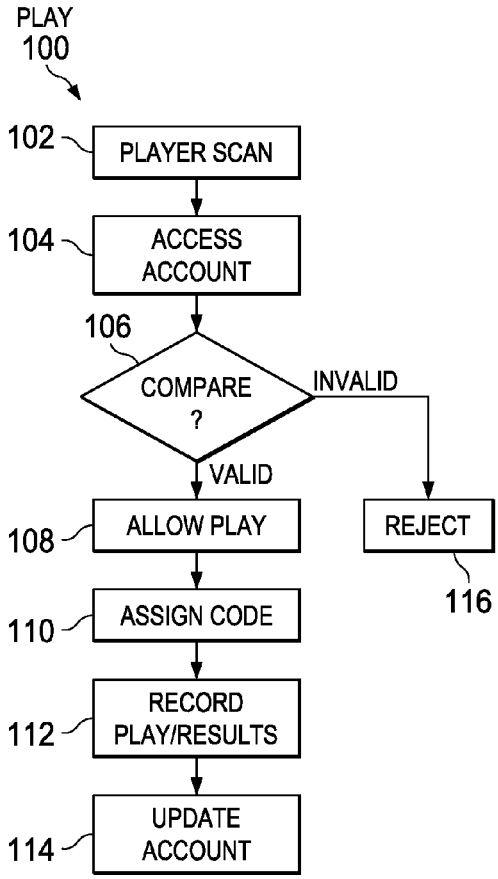
FIG. 5 is a flow chart of a multi-level wagering process according to one embodiment of the present invention.

For example, FIG. 5 depicts a flow chart of a play process 100 of one embodiment of the invention. A multi-level wagering account token or card may be inserted or scanned 102 past a terminal and the multi-level wagering account identification code and matrix information relating to the account (if present), is read. The multi-level wagering account number or identification code is used to access 104 the memory location corresponding to the multi-level wagering account transaction record, to obtain the stored credit balance and outstanding play information for that account transaction. The outstanding account information is used to access the memory location corresponding to the games that may be played and terminal locations that accept game play. Both the on-line and off-line systems may be used, wherein the card or token is taken from an on-line updating and verification system to an off-line gaming machine that reads and verifies the gaming information from the card or token for that account to determine and permit access to a gaming machine.

In one example, the multi-level wagering account information is compared 106 with the current matrix for the account to which it pertains. If this information coincides, the proposed play is accepted by the gaming machine and play is allowed 108 to proceed; with the value thereof subtracted from the altered balance to form an updated credit balance. A new identification code corresponding to this transaction may be assigned 110 and stored off-line or transmitted in an on-line system. Information concerning the accepted play is stored 112, as is the credit balance information, in the memory location corresponding to the newly assigned identification code. If using an off-line system, the account and play information is updated directly on the card, and either the gaming machine at a later time or the card when input back into an on-line system updates 114 a hub or central multi-level wagering account databank and/or processor.

If the proposed game play is accepted, the card, account information or taken previously input or read by the gaming machine terminal updates the multi-level wagering account data. The player may then receive or view an acknowledgment of the updated multi-level wagering account balance and an acknowledgment of the acceptance of future play on the gaming machine if the multi-level wagering account has a positive balance. In addition, if the player prefers to maintain the earnings from a successful play on a gaming machine, the account may be updated to contain the play credit information, eliminating the need to collect the earnings immediately. The account may therefore also contain information relating to accumulated cash winnings from a gaming machine. Actual cash value may then also be used to purchase new multi-level wagering accounts or paid out on demand.

Typically, a gaming or display terminal is provided with, e.g., a keyboard to enter account information and a password or biometric data, an entrance port into which a card (e.g., a smart card) is inserted, a spot over which a token (e.g., a smart token) is passed or a thumbprint taken. Using a card as an example, after the presence of the card is sensed in the entrance port, the card is conveyed from the entrance port to a card reader. After the card is read, it is held in escrow at that location until after the account information is displayed, more accounts are purchased or the player has redeemed the value of the account in a gaming machine and the account information, in this case on a card, has been accepted or rejected. The identification code is verified as to form and if the form is improper, a rejection signal is generated, an error message displayed and the card is returned to the entrance port.

If the proposed account does not coincide with possible valid accounts, a rejection signal is generated 116, an error message displayed and the card returned to the entrance port. If the proposed wager information coincides with the possible valid accounts, the altered credit balance is tested to determine if same is larger than the value of the proposed play on a gaming machine, e.g., the value of each play on the gaming machine. If insufficient funds or play value is present to cover the proposed wager, a rejection signal is generated, an error message displayed and the proposed play on the gaming machine is rejected. If sufficient funds or play value is present, the proposed play is accepted and the value of same is deducted from the altered multi-level wagering account balance to form an updated multi-level wagering account balance, which information is stored along with the information concerning the accepted play.

Upon acceptance of the play, an acceptance signal is generated that causes a new record transaction identification code to be assigned 110 for the accepted transaction. The gaming results may be held in escrow or released and conveyed to a storage bin. The acceptance signal also causes a new value to be displayed and conveyed to a terminal or even a printer which prints thereon the transaction record identification code corresponding to the accepted play, acknowledgment of the account balance information, and the results of the play on the gaming machine once the game has been played.

After the game on the gaming machine to which the accepted play pertains has been completed, the bettor may re-insert the card into the entrance port of the terminal and the cycle is repeated—paying the winning and accepting a new play. The bettor may place wagers repeatedly in this fashion until his account balance is depleted or he or she wishes to be paid out.

The system may include a central processing unit and a number of remote terminals which are connected through a communication interface. The central processing unit continuously polls each of the terminals in sequence to determine if a transaction is taking place. If it is, the data is received from the remote terminal, processed in the central processing unit and retransmitted back to the terminal. The terminals may be situated at any location, and therefore may be located throughout one or more casinos, at airport terminals, kiosks, automatic teller machines, a hotel room TV or display terminal, a computer terminal or conveniently located off-casino betting locations.

Figure 6:
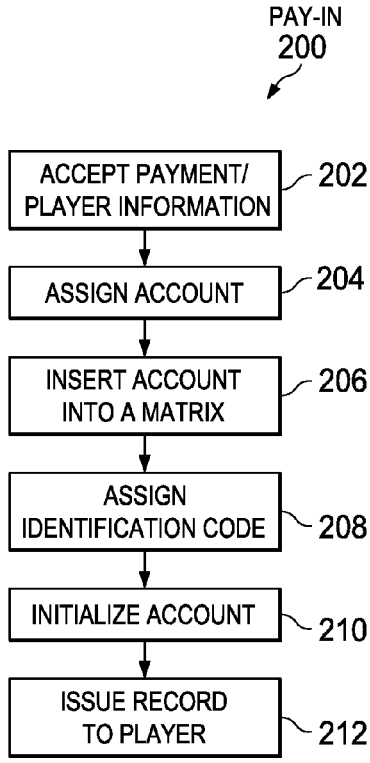
FIG. 6 is a flow chart of a multi-level wagering process according to one embodiment of the present invention.
Figure 7:
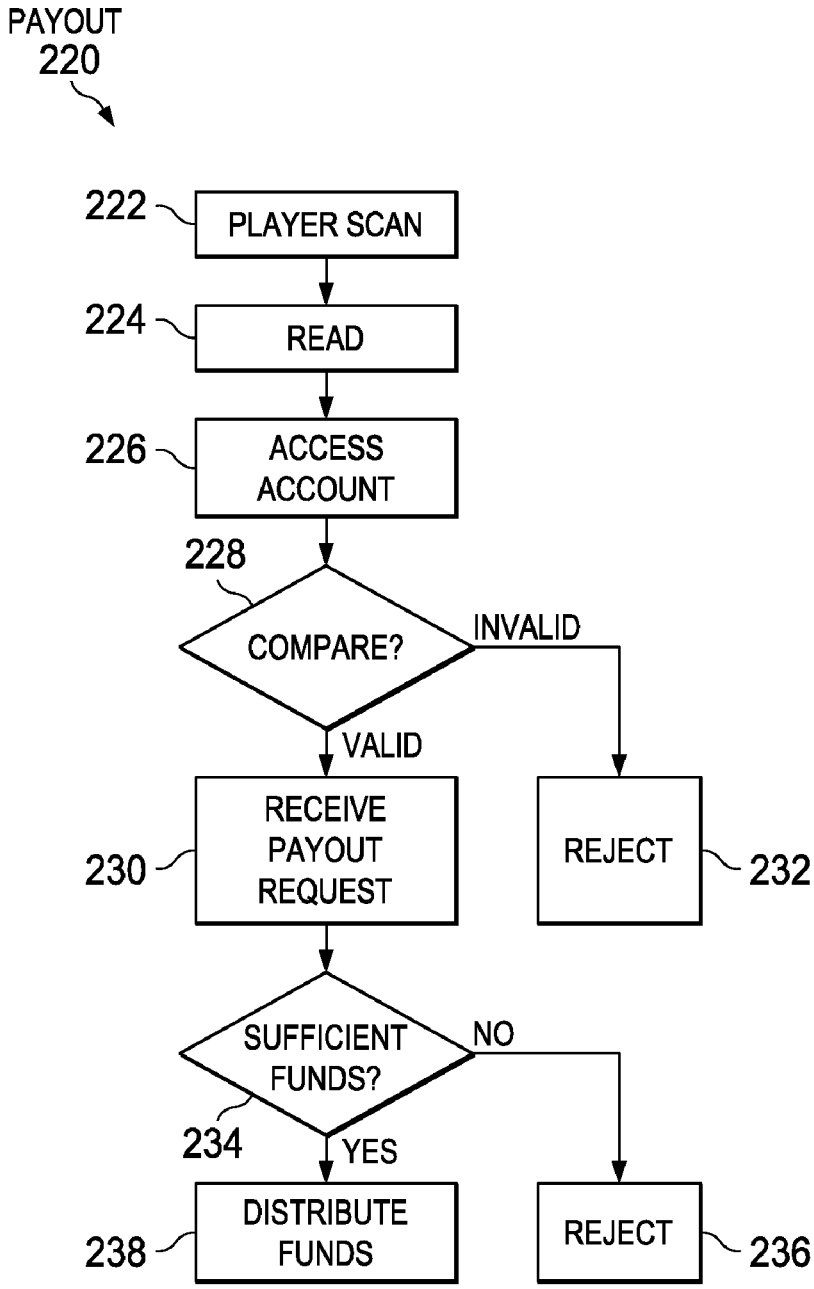
FIG. 7 is a flow chart of a multi-level wagering process according to one embodiment of the present invention.

Referring now to FIGS. 6 and 7, an account pay-in procedure 200 and account payout procedure 220 are depicted. Pay-in and payout terminals or windows may be located at convenient locations, such as at the entrance of the casino or at the exits from gaming machine rooms. As depicted in FIG. 6, upon purchasing a multi-level wagering account, the player pays in an amount equal to the credit balance desired 202. A keypad or other input device on the terminal may allow the player to enter information such as address, phone number, age, or other personal information that may be used by a casino for internal marketing purposes. The account balance is transmitted to the central processing unit which assigns a multi-level wagering account identification code 204, stores the account information, creates a matrix or places the account within an existing matrix 206 and authorizes a transaction record to be stored, displayed, printed, etc., which contains the multi-level wagering account identification code 208 and an acknowledgment of the account balance. The account is then initialized 210 to allow the bettor to begin wagering the account balance in gaming machines that are configured to accept the account for play. The bettor needs only to decide in advance the denomination of each of the accounts he wishes to purchase. A hard transaction record, if requested by the account holder, may then be issued 212.

In this manner, money handling and waiting time is reduced. Transactions are therefore quick, easy and errorless and security and confidentiality are enhanced. The account holder may decide to always have a hard transaction record (e.g., on a card, token, printed), which acts as a receipt for his current balance and any outstanding plays accumulated or left in the account. The central processing unit also has this information. The same card may be used by the bettor to purchase game play and when inserted into the terminal, the central processing unit not only acknowledges and accepts the proposed play, but also alters the account and play credit balance according to any games played or new entries in the matrix below the account. Hard-copies, cards or token give the player may contain each unique ticket transaction identification code, the current balance information, and a form upon which information pertaining to the next transaction may be entered. When using a code name and password or biometric data to associate a purchased account(s), the player need only remember this information without the need to carry or accumulate cards, token, etc., and the account information is stored at, e.g., a central computer or computer hub.

In another embodiment, storage requirements of the system are reduced by recording the account balance and outstanding play information in machine-readable form. Account information need no longer be stored in the memory, as it is obtained from the machine-readable form as it is read. The remaining operations of the system remain unchanged, except for the elimination of the necessity of assigning identification codes for each ticket transaction record.

Referring in particular to FIG. 7, a player may claim any winnings in his account at the payout terminal. The player may enter or scan the account into the terminal 222 and the terminal reads information associated with the player's account 224. The terminal accesses the account 226 in the central processing unit and compares 228 account information with records stored in the central processing unit. If the player's account is valid the terminal receives the player's payout request 230. If the account information does not match the records in the central processing unit the account is rejected 232 and an error message is displayed. The player may specify to payout all of the available funds in an account or only a portion of the account balance. The terminal determines if the account has sufficient funds 234 to meet the player's request and rejects the request 236 if the account has insufficient funds. Otherwise, the terminal distributes the specified funds 238. In one embodiment, the terminal may operate similarly to an automated teller machine (ATM) and distribute cash directly to the player. In another embodiment the terminal may distribute account funds as tokens or casino chips. The terminal may also, for example, wire account funds to a player's: bank account or apply the funds to the player's casino hotel bill.

Figure 9:
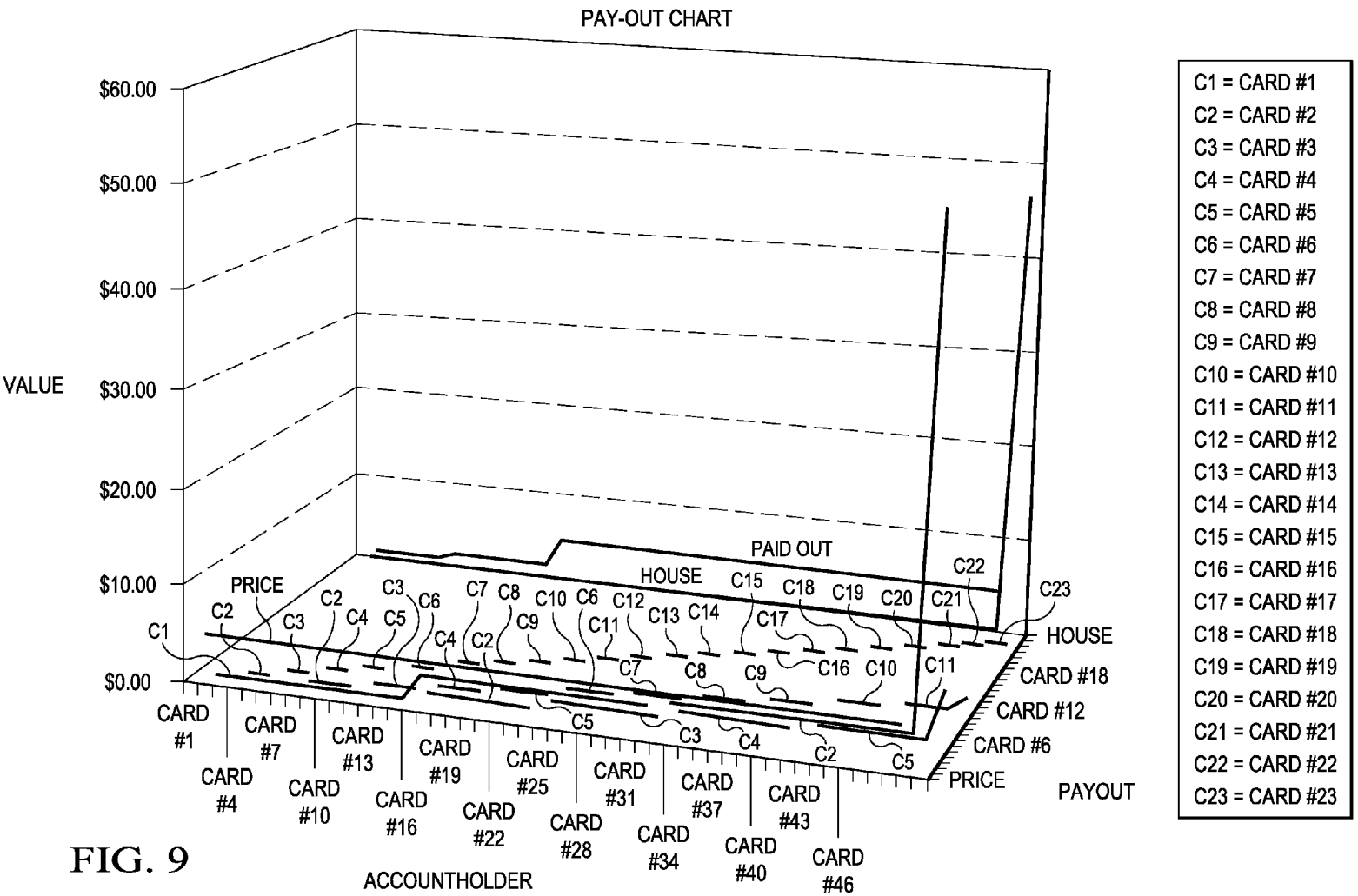
FIG. 9 is a three-dimensional chart that summarizes the spreadsheet composite of FIGS. 8A to 8D.

The operation of the present invention is shown in one example over the spread sheet summary that demonstrates a pay-out scheme of FIGS. 8A to 8D. The pay-out is shown as a $5.00 purchase from cardholder #2 is spread out over cardholders that are above in the matrix. This example displays a pay-out formula for a binary four level matrix. FIGS. 8A to 8D are an illustration tracks the distribution of funds from each accountholders up to 47 cardholders. FIG. 9 is a three-dimensional graphic representation of the data shown in FIGS. 8A to 8D in which the pay-out may be tracked by cardholder and the contribution of each cardholder is plotted against the final pay-out and the contribution to the House. In this example, the matrix only requires that a predetermined number of players purchase a multi-level wagering account to be fully complete. A gaming institution earns money from selling the multi-level wagering account because the entire purchase price is not distributed back to the players in gaming play. The gaming institution also earns the gaming profits from all the wagering done by of the multi-level wagering account in any particular gaming machine. The player receives the accumulated number of plays from the account and any winnings that may result from exercising the accumulated number of plays in a gaming machine are instantly converted to the player's multi-level cash account and may be withdrawn on demand.

Other embodiments of the present invention may include: (1) a system that includes one or more multi-level wagering accounts, a processor communicably coupled to the one or more gaming machines that distributes play value in the one or more multi-level wagering accounts from a portion of the sales price of other multi-level wagering accounts, and one or more gaming machines wherein at least a portion of the play value from the one or more multi-level wagering accounts may be used to purchase a play; (2) a method of accumulating play value in a multi-level wagering account, and using the accumulated play value in a gaming machine; (3) a system that includes one or more multi-level wagering accounts, a processor communicably coupled to the one or more gaming machines that distributes play value in the multi-level wagering accounts from a portion of the sales price of the subsequent purchase of multi-level wagering accounts until a predetermined play value is achieved, and one or more gaming machines operated by the play value from the one or more multi-level wagering accounts; (4) a method of purchasing at least one multi-level wagering account, accumulating play value in the multi-level wagering account until a predetermined play value is achieved, and using the play value accumulated in the multi-level wagering account to purchase a play; (5) a system that includes one or more multi-level wagering cards, a processor that distributes play value in the multi-level wagering cards from a portion of the sales price of other multi-level wagering cards until a predetermined play value is achieved, and one or more gaming machines capable of being operated by play value from the one or more multi-level wagering cards; (6) a method of purchasing at least one multi-level wagering account, accumulating play value in the multi-level wagering account, and using the multi-level wagering account's accumulated play value to purchase a play; and (7) a system that includes one or more multi-level wagering cards, a means for distributing play value in the multi-level wagering cards from a portion of the sales price of other multi-level wagering cards until a predetermined play value is achieved, and one or more gaming machines capable of being operated by play value from the one or more multi-level wagering cards. Note that any of the methods described herein can be implemented as a computer program embodied on a computer readable medium wherein the various steps are performed by one or more code segments.

Although this invention has been described with reference to an illustrative embodiment, this description is not intended to limit the scope of the invention. Various modifications and combinations of the illustrative embodiments as well as other embodiments of the invention will be apparent to persons skilled in the art upon reference to the description. It is therefore intended that the appended claims accomplish any such modifications or embodiments.

What is claimed is:

1. A system for wagering comprising:

a vending device that accepts a sales price from a current user and assigns a multi-level wagering account having a play value initially equal to or slightly less than equal to the sales price to the current user;

one or more gaming machines wherein at least a portion of the play value from the multi-level wagering account may be used to purchase a play;

a processor communicably coupled to the vending device and the one or more gaming machines that distributes the entire sales price accepted from the current user to a specified number of previous users and an operator of the system in accordance with a payout formula, which is not based on a play of any user, by increasing the play value of one or more multi-level wagering accounts of the specified previous users, increases the play value of the multi-level wagering account of the current user based on the sales price accepted from a specified number of subsequent users in accordance with the payout formula and decreases the play value of the multi-level wagering account of the current user based on the plays purchased by the current user at the one or more gaming machines; and a data storage device communicably coupled to the processor that stores the play value of each multi-level wagering account.

2. The system of claim 1, wherein the vending device and the gaming machine are integrated into a single device.

3. The system of claim 1, wherein the processor and the data storage device are integrated into a computer.

4. The system of claim 1, wherein the processor further distributes a portion of the play value of the multi-level wagering account of the current user in accordance with the payout formula to the operator of the system when the specified number of subsequent users has been reached.

5. The system of claim 1, wherein each multi-level wagering account expires after a given time period and any unused play value for an expired multi-level wagering account is distributed to an operator of the system.

6. The system of claim 1, wherein the vending device provides the current user with information about the multi-level wagering account that allows the current user to purchase the play on the one or more gaming machines.

7. The system of claim 1, wherein the information is stored in an electronic account, or electronically or magnetically a card, a smart card, a chip, a RFID device, a token, a personal data assistant, a communications device or other personal item.

8. The system of claim 6, wherein the information comprises an account number and a password or biometric data.

9. The system of claim 1, wherein the one or more gaming machines are one or more video slot machine, video poker or blackjack machine, one or more computer games or a network-based gaming system accessible by one or more computers or communication devices.

10. The system of claim 1, wherein the vending device is a network-based electronic accounting system associated with a network-based gaming system.

11. The system of claim 1, wherein the payout formula, the specified number of previous users and the specified number of subsequent users are predetermined, randomized or a combination thereof.

12. The system of claim 11, wherein the predetermined payout formula is at least a one-level matrix.

13. The system of claim 11, wherein the predetermined payout formula is at least a four-level matrix.

14. The system of claim 1, wherein the processor records the quantity of play accumulated for each multi-level wagering account in the data storage device.

15. The system of claim 1, wherein the processor records one or more winnings resulting from using the multi-level wagering account in the one or more gaming machines in the data storage device.

16. The system of claim 15, wherein the winnings are associated with the multi-level wagering account, displayed at a remote location, transferred to a multi-level wagering account, used to place one or more wagers or exchanged for cash.

17. The system of claim 1, wherein the play value of one or more multi-level wagering accounts is accessed from a remote location.

18. A method for wagering comprising the machine implemented steps of:

receiving a sales price from a current user;

assigning a multi-level wagering account having a play value initially equal to or slightly less than equal to the sales price to the current user wherein a portion of the play value may be used to purchase a play on one or more gaming machines;

distributing the entire sales price received from the current user to a specified number of previous users and an operator of the system in accordance with a payout formula, which is not based on a play of any user, by increasing the play value of one or more multi-level wagering accounts of the specified previous users;

increasing the play value of the multi-level wagering account of the current user based on the sales price accepted from a specified number of subsequent users in accordance with the payout formula; and decreasing the play value of the multi-level wagering account of the current user based on the plays purchased by the current user at the one or more gaming machines.

19. The method of claim 18, further comprising the step of distributing a portion of the play value of the multi-level wagering account of the current user in accordance with the payout formula to the operator of the system when the specified number of subsequent users has been reached.

20. The method of claim 18, wherein each multi-level wagering account expires after a given time period and any unused play value for an expired multi-level wagering account is distributed to an operator of the system.

21. The method of claim 18, further comprising the step of providing the current user with information about the multi-level wagering account that allows the current user to purchase the play on the one or more gaming machines.

22. The method of claim 21, wherein the information is stored in an electronic account, or electronically or magnetically a card, a smart card, a chip, a RFID device, a token, a personal data assistant, a communications device or other personal item.

23. The method of claim 21, wherein the information comprises an account number and a password or biometric data.

24. The method of claim 18, wherein the one or more gaming machines are one or more video slot machine, video poker or blackjack machine, one or more computer games or a network-based gaming system accessible by one or more computers or communication devices.

25. The method of claim 18, wherein the payout formula, the specified number of previous users and the specified number of subsequent users are predetermined, randomized or a combination thereof.

26. The method of claim 25, wherein the predetermined payout formula is at least a one-level matrix.

27. The method of claim 25, wherein the predetermined payout formula is at least a four-level matrix.

28. The method of claim 18, further comprising the step of recording the quantity of play accumulated for each multi-level wagering account.

29. The method of claim 18, further comprising the step of recording one or more winnings resulting from using the multi-level wagering account in the one or more gaming machines.

30. The method of claim 29, wherein the winnings are associated with the multi-level wagering account, displayed at a remote location, transferred to a multi-level wagering account, used to place one or more wagers or exchanged for cash.

31. The method of claim 18, further comprising the step of accessing the play value of one or more multi-level wagering accounts from a remote location.

32. A computer program embodied on a computer readable medium comprising:

a code segment for receiving a sales price from a current user;

a code segment for assigning a multi-level wagering account having a play value initially equal to or slightly less than equal to the sales price to the current user wherein a portion of the play value may be used to purchase a play on one or more gaming machines;

a code segment for distributing the entire sales price received from the current user to a specified number of previous users and an operator of the system in accordance with a payout formula, which is not based on a play of any user, by increasing the play value of one or more multi-level wagering accounts of the specified previous users;

a code segment for increasing the play value of the multi-level wagering account of the current user based on the sales price accepted from a specified number of subsequent users in accordance with the payout formula; and a code segment for decreasing the play value of the multi-level wagering account of the current user based on the plays purchased by the current user at the one or more gaming machines.

33. A computerized method of multi-level wagering comprising the steps of:

accumulating play value in a current multi-level wagering account stored on a computer from a portion of the sales price of a specified number of multi-level wagering accounts stored on the computer and purchased subsequent to the current multi-level wagering account in accordance with a payout formula, which is not based on a play of any user, as calculated by the computer, wherein the play value in the current multi-level wagering account was initially equal to or slightly less than equal to a sales price paid by a current user and the entire sales price of the paid by the current user was distributed to a specified number of previous users and an operator of the system in accordance with the a out formula; and using the accumulated play value by the current user in a gaming machine communicably coupled to the computer.

34. The method of claim 33, wherein the step of purchasing at least one multi-level wagering account is by purchasing from a video slot machine or a vending machine.

35. The method of claim 34, wherein the video slot machine or vending machine is computerized.

36. The method of claim 33, wherein the payout formula and the specified number of subsequent multi-level wagering accounts are predetermined, randomized or a combination thereof.

37. The method of claim 36, wherein the predetermined payout formula is at least a one-level matrix.

38. The method of claim 36, wherein the predetermined payout formula is at least a one-level matrix.

39. The method of claim 33 wherein a computer records the quantity of play accumulated in one or more multi-level wagering accounts.

40. The method of claim 33, wherein the computer records winnings resulting from using the multi-level wagering account in a gaming machine.

41. The method of claim 40, wherein the winnings are associated with the multi-level wagering account, displayed at a remote location, transferred to a multi-level wagering account, used to place one or more wagers or exchanged for cash.

42. The method of claim 41, further comprising the step of transferring the winnings associated with the multi-level wagering account to another multi-level wagering account.

43. The method of claim 41, further comprising the step of using the winnings associated with the multi-level wagering account to place one or more wagers.

44. The method of claim 41, further comprising the step of exchanging the winnings associated with the multi-level wagering account for cash.

45. The method of claim 33, further comprising the step of accessing the play value of one or more multi-level wagering accounts from a remote location.

* * * * *